US008387604B1

(12) United States Patent
Terzo

(10) Patent No.: US 8,387,604 B1
(45) Date of Patent: Mar. 5, 2013

(54) COMPOUND BOW

(76) Inventor: Michael Burl Terzo, Missoula, MT (US)

( * ) Notice: Subject to any disclaimer, the term of this patent is extended or adjusted under 35 U.S.C. 154(b) by 307 days.

(21) Appl. No.: 12/802,291

(22) Filed: Jun. 3, 2010

Related U.S. Application Data

(60) Provisional application No. 61/184,836, filed on Jun. 7, 2009.

(51) Int. Cl.
*F41B 5/00* (2006.01)

(52) U.S. Cl. ..... 124/25.6; 124/23.1; 124/25

(58) Field of Classification Search ..... 124/23.1, 124/25, 25.6, 86, 88
See application file for complete search history.

(56) References Cited

U.S. PATENT DOCUMENTS

| | | | | |
|---|---|---|---|---|
| 4,201,177 | A * | 5/1980 | Holman et al. | 124/25.6 |
| 4,858,588 | A * | 8/1989 | Bozek | 124/23.1 |
| 4,971,020 | A * | 11/1990 | Soderstrom et al. | 124/23.1 |
| 5,054,463 | A * | 10/1991 | Colley et al. | 124/25.6 |
| 6,792,931 | B1 * | 9/2004 | Schaar | 124/25.6 |
| 7,578,289 | B2 * | 8/2009 | Norkus | 124/25.6 |
| 2006/0011181 | A1 * | 1/2006 | Andrews | 124/23.1 |

* cited by examiner

*Primary Examiner* — John Ricci

(57) ABSTRACT

A compound bow, recurve bow, long bow, or crossbow with two idler pulleys that allow for a faster decrease in bowstring angle in relation to the arrow thereby increasing the amount of stored energy during the draw stroke and decreasing the distance required to reach peak draw weight. The two idler pulleys also allow the force draw curve to be designed around the human body kinematic strengths as opposed to the limitations of the bow geometry.

12 Claims, 7 Drawing Sheets

COMPOUND BOW

CROSS-REFERENCE TO RELATED APPLICATIONS

This application claims the benefits of U.S. Provisional Application Ser. No. 61/184,836 filed Jun. 7, 2009, the disclosure of which is hereby incorporated by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of archery equipment. More particularly, the present invention is in the technical field of bow and crossbow design.

Bows have been used for a long time to propel an arrow at a higher velocity than a human arm is capable of. Many improvements to bows have been made over thousands of years. In general, these improvements include recurve bows, long bows, and compound bows with compound bows being the most recent improvement. All of these improvements have been either to increase speed, improve accuracy, or change the draw comfort. More specifically, the compound bow uses pulleys or cams that are designed to maximize the energy stored and released from the limbs and provide a let-off at the end of the draw. These cams make tuning the bow and designing the force draw curve very complex and difficult. However, all these components are limited due to the design of the bow and none of these improvements have changed the angle of the bowstring in relation to the upper and lower limb tips. Many new devices have been developed in an attempt to perfect the bow (see, for example, U.S. Pat. Nos. 3,854,467; 3,967,609; 3,987,777; 4,246,883; 4,457,288; 4,649,890; 4,667,649; 4,683,865; 4,757,799; 4,817,580; 6,055,974; 6,098,607; 6,776,148 B1; 6,792,931 B1; 7,047,958 B1; and U.S. Patent Application Publication Nos. 2007/0193568 A1; 2007/0044782 A1; 2009/0032002 A1; 2008/0251058 A1; and 2010/0000504 A1). A need remains however for a bow that has simplicity in design, increased speed and ease of tuning.

All patents, patent applications, provisional patent applications and publications referred to or cited herein, are incorporated by reference in their entirety to the extent they are not inconsistent with the teachings of the specification.

BRIEF SUMMARY OF THE INVENTION

The present invention is a bow device used to propel projectiles having two idler pulleys mounted on the shooter or rearward side of the bow riser to change the angle of the bowstring of the bow. The idler pulleys of the subject invention allow the bowstring to be redirected during the draw, thus changing the angle of the bowstring relative to a horizontal plane. Changing the angle of the bowstring in relation to a horizontal plane, increases the amount of energy that can be stored in the bow limbs at the beginning of the draw stroke.

Changing the angle of the bowstring also allows for the power stroke to be designed around the strength of the human body as opposed to being limited by the geometry of the bow. When mounted on a compound bow, the idler pulleys allow for a simplified design of the cams since the bowstring always comes off the cam at the same angle throughout the draw and reduces the amount of non planar torque put on the cams that can lead to cam lean. The present invention may also be incorporated into a crossbow with the same advantages being realized.

The idler pulleys of the present invention, in one possible configuration and by non-limiting example, may be mounted close to the riser.

The idler pulleys of the present invention, in another possible configuration and by non-limiting example, may be mounted at some distance from the riser.

One aspect is a recurve bow comprising a riser, two limbs, and two idler pulleys. The two idler pulleys are mounted in a vertical plane at equal distances above and below the center point of the bow.

Another aspect is a long bow comprising a single riser and limb body, and two idler pulleys. The two idler pulleys are mounted in a vertical plane at equal distances above and below the center point of the bow.

Another aspect is a compound bow comprising a riser, two limbs, two cams, and two idler pulleys. The two idler pulleys are mounted in a vertical plane at equal distances above and below the center point of the bow.

Yet another aspect is a crossbow comprising a stock, two limbs, two cams, and two idler pulleys. The two idler pulleys are mounted in a horizontal plane at equal distances to the left and right of the center point of the crossbow.

DETAILED DESCRIPTION OF THE INVENTION

Figure 1:
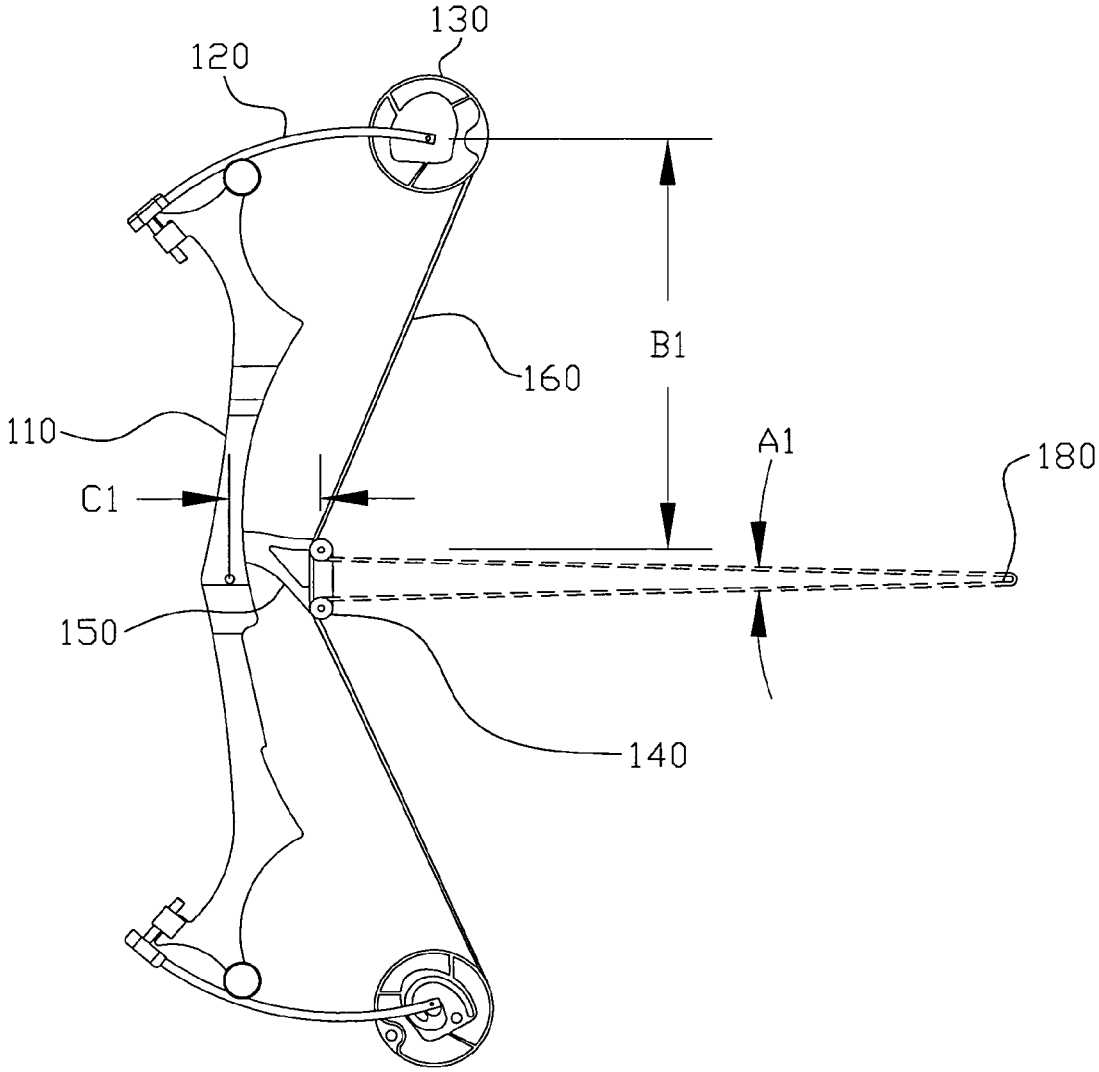
FIG. 1 is a left side elevational view of an exemplary compound bow of the present invention.

Referring now to the invention in more detail, in FIG. 1 there is shown a compound bow having a riser 110, limbs 120, cams 130, nocking point 180, bowstring 160, and idler pulleys 140 held in a substantially vertical position by the idler pulley support 150.

In more detail, still referring to the invention of FIG. 1, the idler pulleys 140 are positioned in a vertical plane between the cams 130. Idler pulleys 140 are shown a distance C1 away from the riser 110 in the horizontal plane and a distance B1 away from the cams 130 in the vertical plane. The bowstring 160 forms an angle A1 when in the drawn position. This angle A1 is smaller than the angle found in prior art and is preferably in the range of 5 degrees to about 45 degrees. Distance C1 is preferably in the range of 1 inch to about 8 inches. Distance B1 is preferably in the range of 12 inches to about 18 inches. Other embodiments include other dimensions.

In further detail, still referring to the invention of FIG. 1, the idler pulleys 140 are spaced sufficiently far apart in the vertical plane as to allow an arrow to pass by, such as about 1 to 2 inches apart. The idler pulleys 140 are of a sufficient diameter as to not interfere with the bow string 160 movement, such as about 0.25 to 4 inches in diameter.

The construction details of the invention as shown in FIG. 1 are that the idler pulleys 140 may be made of aluminum or any sufficiently rigid and strong material such as composites, metal or high strength plastics. Further, the various components of the compound bow can be made of different materials.

Figure 2:
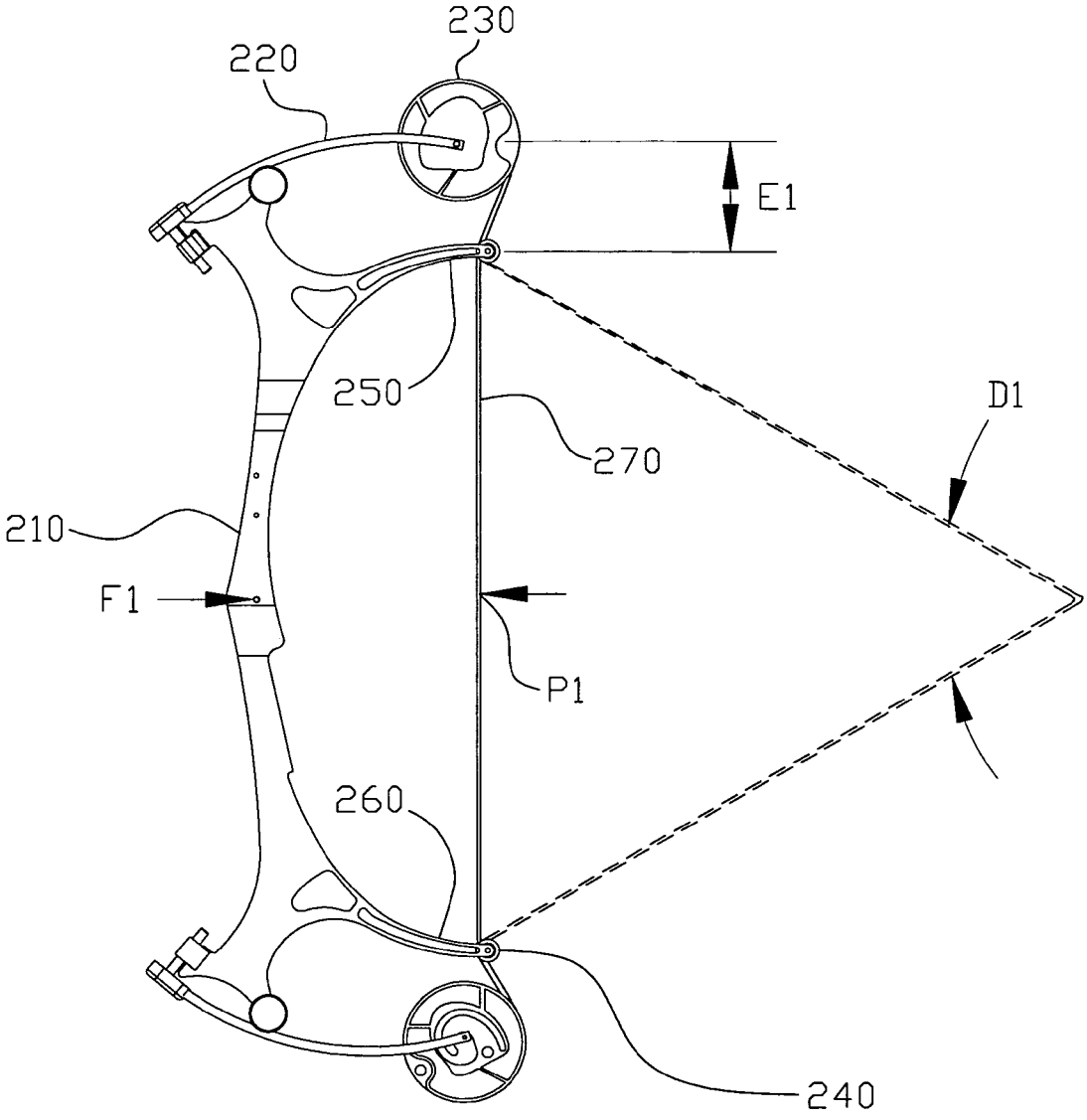
FIG. 2 is a left side elevational view of another exemplary compound bow of the present invention.

Referring now to FIG. 2 there is shown a compound bow having a riser 210, limbs 220, cams 230, nocking point P1, bowstring 270, and idler pulleys 240 held in a substantially vertical position by the upper idler pulley support 250, lower idler pulley support 260.

In more detail, still referring to the invention of FIG. 2, the idler pulleys 240 are positioned in a vertical plane between the cams 230. Idler pulleys 240 are shown a distance F1 away from the riser 210 in the horizontal plane and a distance E1 away from the cams 230 in the vertical plane. The bowstring 270 forms an angle D1 when in the drawn position. This angle D1 is smaller than the angle found in prior art and is preferably in the range of 5 degrees to about 90 degrees. Distance F1 is preferably in the range of 1 inch to about 8 inches. Distance E1 is preferably in the range of 3 inches to about 10 inches. Other embodiments include other dimensions.

In further detail, still referring to the invention of FIG. 2, the idler pulleys 240 are spaced sufficiently far apart from the cams 230 in the vertical plane as to allow the cams 230 to operate effectively, such as at least 3 inches from the centerline of the cams 230 to the centerline of the idler pulleys 240. The idler pulleys 240 are of a sufficient diameter as to not interfere with the bowstring 270 movement, such as about 0.25 to 3 inches in diameter.

The construction details of the invention as shown in FIG. 2 are that the idler pulleys 240 may be made of aluminum or any sufficiently rigid and strong material such as composites, metal or high strength plastics. Further, the various components of the compound bow can be made of different materials.

Figure 3:
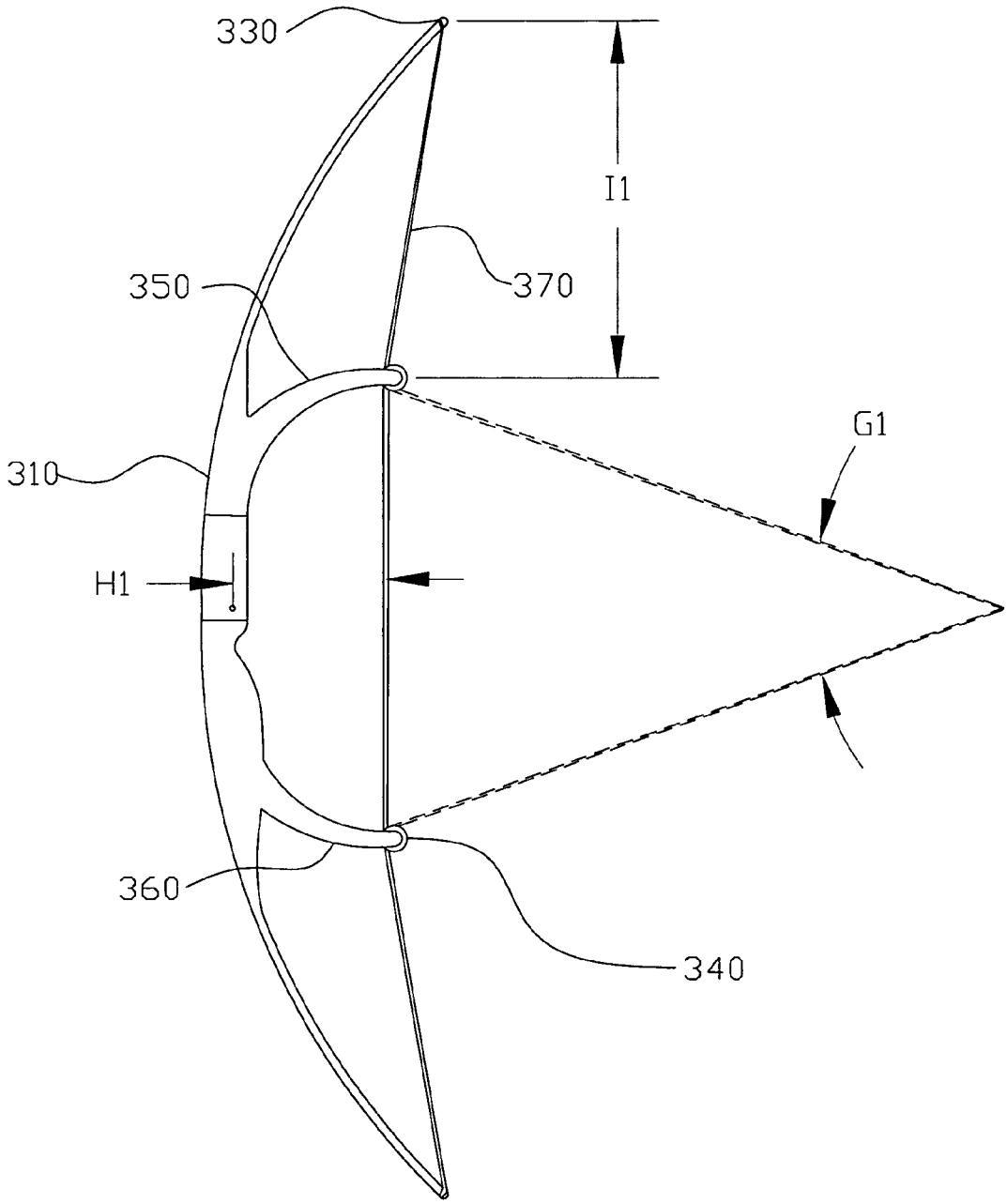
FIG. 3 is a left side elevational view of an exemplary long bow of the present invention.

Referring now to FIG. 3 there is shown a long bow having a riser 310, bowstring 370, and idler pulleys 340 held in a substantially vertical position by the upper idler pulley support 350, lower idler pulley support 360.

In more detail, still referring to the invention of FIG. 3, the idler pulleys 340 are positioned in a vertical plane between limb tips 330. Idler pulleys 340 are shown a distance H1 away from the riser 310 in the horizontal plane and a distance I1 away from the limb tips 330 in the vertical plane. The bowstring 370 forms an angle G1 when in the drawn position. This angle G1 is smaller than the angle found in prior art and is preferably in the range of 5 degrees to about 65 degrees. Distance H1 is preferably in the range of 1 inch to about 10 inches. Distance I1 is preferably in the range of 12 inches to about 24 inches. Other embodiments include other dimensions.

In further detail, still referring to the invention of FIG. 3, the idler pulleys 340 are spaced sufficiently far apart in the vertical plane as to allow an arrow to pass by, such as at least 2 inches apart. The idler pulleys 340 are of a sufficient diameter as to not interfere with the bowstring 370 movement, such as about 0.25 to 4 inches in diameter.

The construction details of the invention as shown in FIG. 3 are that the idler pulleys 340 may be made of aluminum or any sufficiently rigid and strong material such as composites, metal or high strength plastics. Further, the various components of the long bow can be made of different materials.

Figure 4:
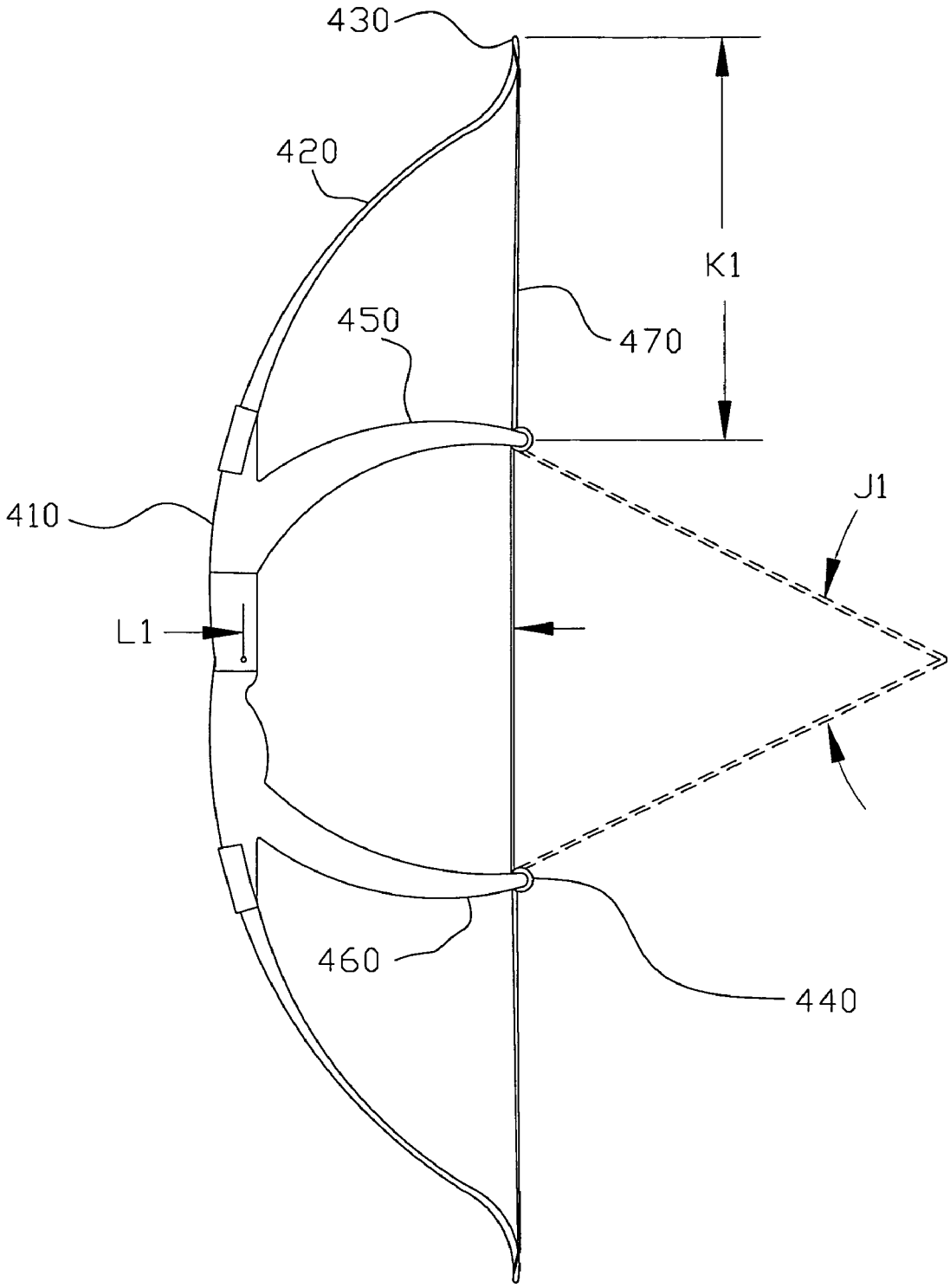
FIG. 4 is a left side elevational view of an exemplary recurve bow of the present invention.

Referring now to FIG. 4 there is shown a recurve bow having a riser 410, limbs 420, bowstring 470, and idler pulleys 440 held in a substantially vertical position by the upper idler pulley support 450, lower idler pulley support 460.

In more detail, still referring to the invention of FIG. 4, the idler pulleys 440 are positioned in a vertical plane between the limb tips 430. Idler pulleys 440 are shown a distance L1 away from the riser 410 in the horizontal plane and a distance K1 away from the limb tips 430 in the vertical plane. The bowstring 470 forms an angle J1 when in the drawn position. This angle J1 is smaller than the angle found in prior art and is preferably in the range of 5 degrees to about 45 degrees. Distance L1 is preferably in the range of 1 inch to about 10 inches. Distance K1 is preferably in the range of 10 inches to about 24 inches. Other embodiments include other dimensions.

In further detail, still referring to the invention of FIG. 4, the idler pulleys 440 are spaced sufficiently far apart in the vertical as to allow an arrow to pass by, such as at least 2 inches apart. The idler pulleys 440 are of a sufficient diameter as to not interfere with the bowstring 470 movement, such as about 0.25 to 3 inches in diameter.

The construction details of the invention as shown in FIG. 4 are that the idler pulleys 440 may be made of aluminum or any sufficiently rigid and strong material such as composites, metal or high strength plastics. Further, the various components of the compound bow can be made of different materials.

Figure 5:
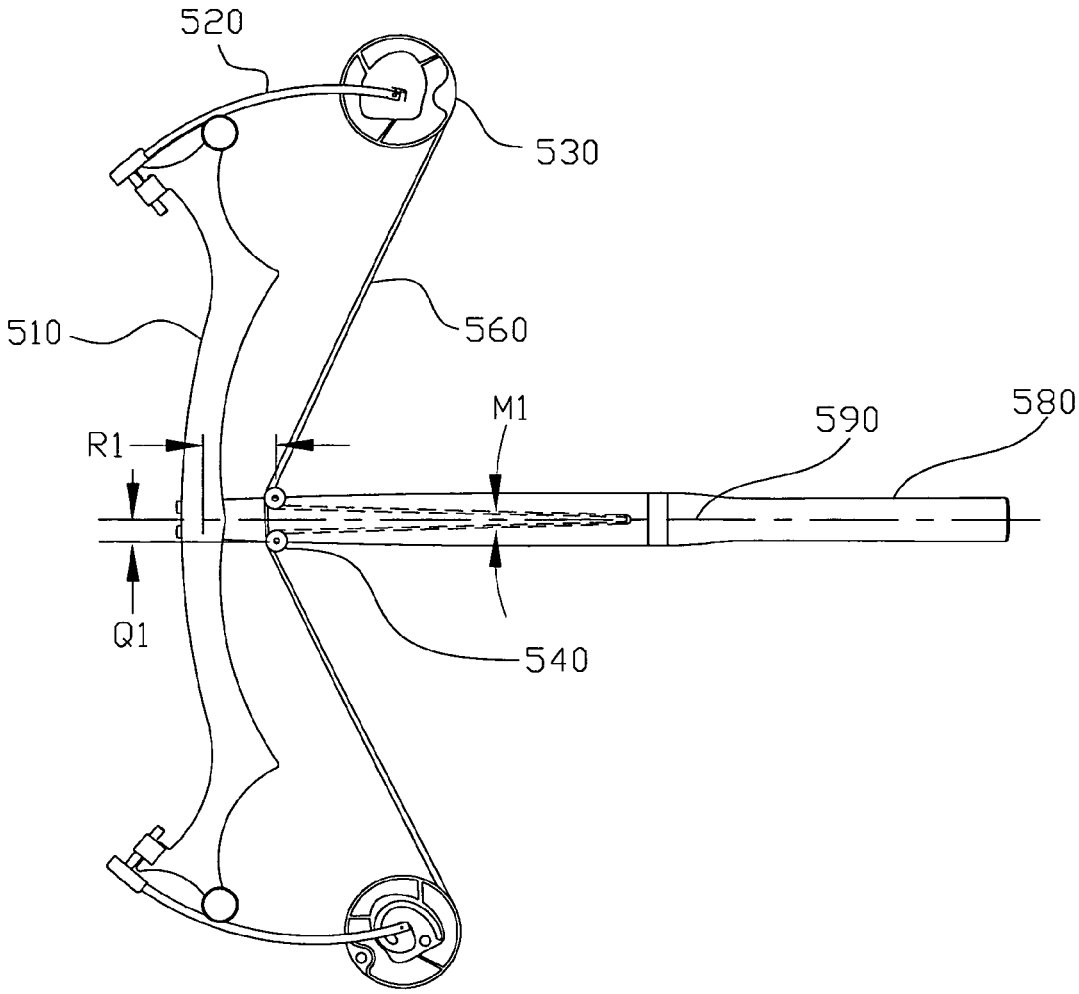
FIG. 5 is a top plan view of an exemplary crossbow of the present invention.
Figure 6:
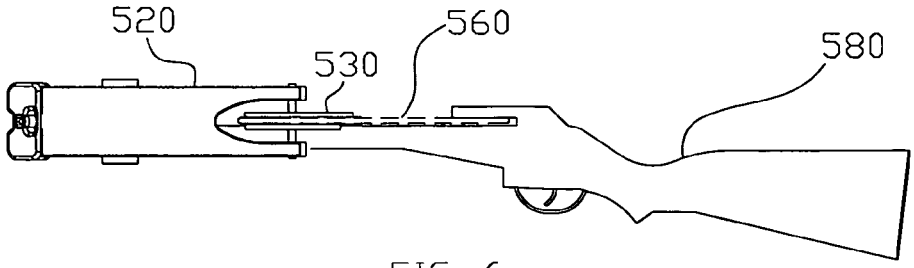
FIG. 6 is a left side elevational view of the crossbow shown in FIG. 5.

Referring now to FIG. 5 and FIG. 6 there is shown a crossbow having a stock 580, riser 510, limbs 520, cams 530, bowstring 560 and idler pulleys 540 held in a substantially horizontal position by the stock 580.

In more detail, still referring to the invention of FIG. 5 and FIG. 6, the idler pulleys 540 are positioned in a horizontal plane between the cams 530. Idler pulleys 540 are shown a distance Q1 away from the stock centerline 590 in the horizontal plane and a distance R1 away from the riser 510 in the horizontal plane. The bowstring 560 forms an angle M1 when in the drawn position. This angle M1 is smaller than the angle found in prior art and is preferably in the range of 2 degrees to about 65 degrees. Distance Q1 is preferably in the range of 0.5 inches to about 4 inches. Distance R1 is preferably in the range of 0.5 inches to about 10 inches. Other embodiments include other dimensions.

In further detail, still referring to the invention of FIG. 5 and FIG. 6, the idler pulleys 540 are spaced sufficiently far apart from the stock centerline 590 in the horizontal plane as to allow an arrow to pass by, such as about 0.5 to 10 inches apart. The idler pulleys 540 are of a sufficient diameter as to not interfere with the bowstring 560 movement, such as about 0.25 to 3 inches in diameter.

The construction details of the invention as shown in FIG. 5 and FIG. 6. are that the idler pulleys 540 may be made of aluminum or any sufficiently rigid and strong material such as composites, metal or high strength plastics. Further, the various components of the compound bow can be made of different materials.

Figure 7:
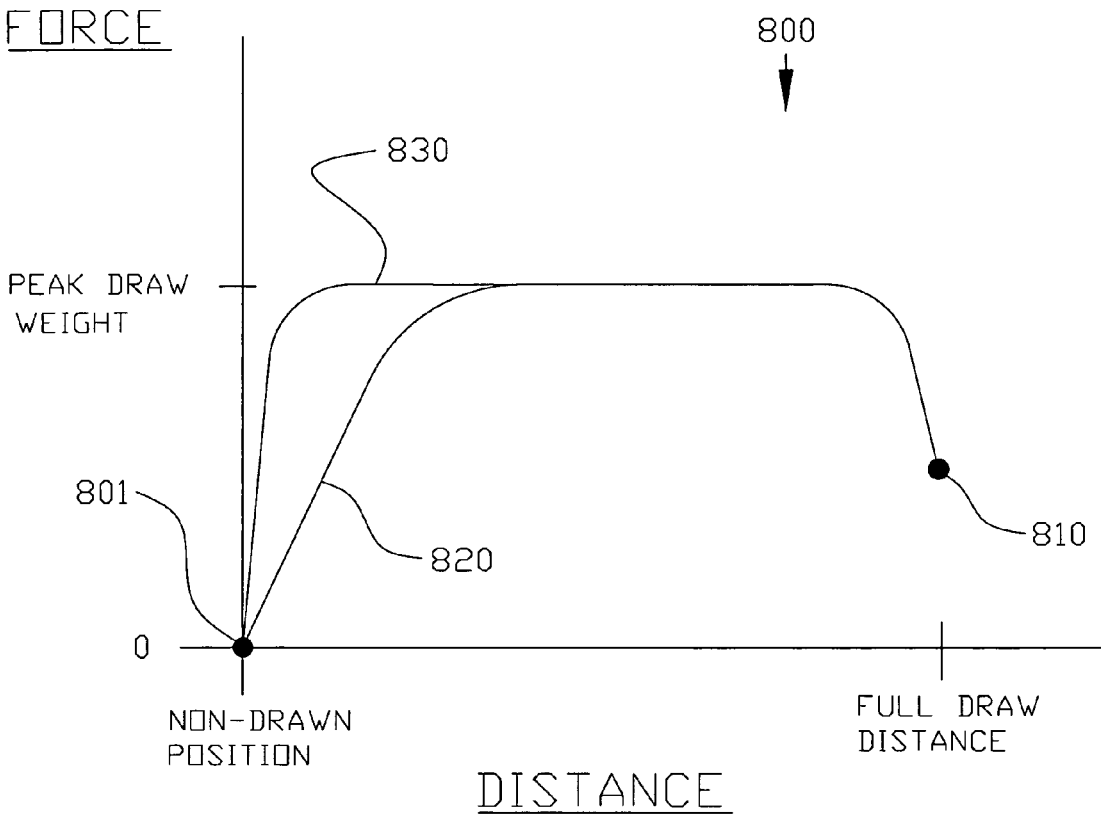
FIG. 7 is an exemplary schematic view of a force-draw curve illustrating the force present at a nocking point of some embodiments of a bow, such as the compound bow shown in FIG. 1.

FIG. 7 refers to an exemplary schematic of a force curve 800 which illustrates the force present at a nocking point of the present invention, such as nocking point 180 shown in FIG. 1. Force curve 800 begins at point 801 and ends at point 810. Force curve 800 includes curve 820 of typical prior art bow and curve 830 of the present invention.

In more detail, still referring to the exemplary schematic view of FIG. 7, force curve 800 shows a steep rise (slope) of curve 830 at the beginning of the draw stroke. This slope of curve 830 exceeds the slope of the prior art curve 820 due to the decreased angle of the bowstring in relation to the arrow such as the angle A1 shown in FIG. 1.

In further detail, still referring to the schematic shown in FIG. 7, the force curve 800 begins at point 801 where the bowstring is in the non-drawn position such as position P1 shown in FIG. 2. An archer draws the bow by applying a rearward force to the nocking point. At the first instant, the force is equal to zero but quickly rises as shown in both curve 820 and curve 830. The peak draw weight is held in a relatively linear line for some distance before the let-off just prior to the end point 810 of force curve 800.

In further detail, still referring to the exemplary schematic shown in FIG. 7, the area under force curve 800 represents the total amount of energy stored in the bow limbs when the bow is in the fully drawn position, and also the amount of energy available for propelling a projectile or arrow, less any friction losses, or any other small system losses. As can be seen in the force curve 800, there is more energy available under the present invention curve 830 than the prior art curve 820. This allows the arrow to be propelled at a higher velocity or a reduced draw weight to be achieved while maintaining the same arrow velocity.

Figure 8:
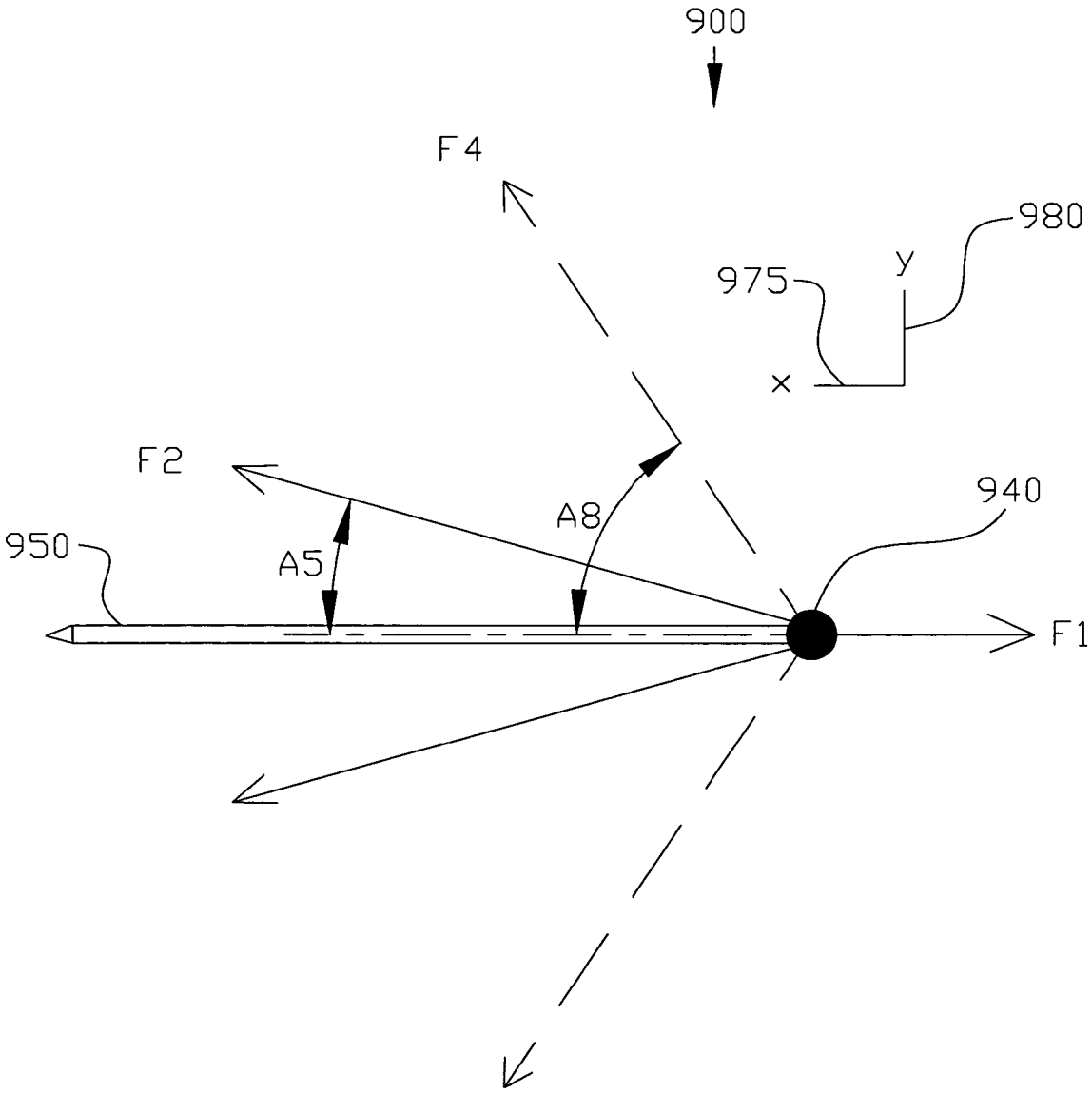
FIG. 8 is an exemplary schematic view of a free body diagram that represents the force present at a nocking point of some embodiments of a bow, such as the compound bow shown in FIG. 1.

Referring now to the exemplary schematic view in FIG. 8, there is shown a free body diagram 900 which includes a nocking point 940, an arrow 950, draw force F1, bowstring tension force F2, and bowstring tension force F4. Free body diagram 900 is orientated in a standard Cartesian coordinate system, shown by x-axis 975 and y-axis 980. Nocking point 940 represents a point on a bowstring where the rearward force by the archer is applied such as nocking point 180 shown in FIG. 1 or point P1 shown in FIG. 2. Draw force F1 is the force applied by the archer to the bowstring of a bow such as the compound bow shown in FIG. 1 or any prior art bow. Bowstring tension force F2 is the resultant force in the bowstring of the present invention bow, such as the compound bow shown in FIG. 1 that is present when draw force F1 is applied to nocking point 940. Bowstring tension force F4 is the resultant force in the bowstring of a prior art bow, such as the compound bow of U.S. Pat. No. 6,776,148, that is present when draw force F1 is applied to nocking point 940.

In more detail, still referring to the exemplary schematic view of FIG. 8, it can be shown through trigonometric calculations, that the bowstring tension force F2 of free body diagram 900 is equal to one half times the x-axis component of draw force F1. The x-axis component is determined by the angle A5 through the Law of Cosines. As angle A5 decreases, the string tension F2 decreases until it is equal to half of F1 when the angle A5 equals zero. The same calculations can be made in a prior art bow using free body diagram 900, draw force F1, bowstring tension F4, and angle A8. Typical prior art bows either have the bowstring attached to the limb tips or the cams, therefore the angle A8 of prior art is determined by the limb tip to limb tip distance or the cam axle to cam axle distance. The angle A5 of the present invention is only determined by the idler pulley spacing distance and is therefore not limited to bow geometry.

In further detail, still referring to the exemplary schematic view of FIG. 8 and the force curve 800 shown in FIG. 7, the draw weight is equal to zero at the first instant but then rises as the angle A5 or angle A8 decreases. Both angle A5 and angle A8 must equal 90 degrees at the non-drawn position shown in FIG. 7. The present invention allows for the angle A5 to decrease faster than that of any prior art bow. This allows for a steeper increase of the curve 830 and a greater amount of energy to be stored in the bow limbs, thus increasing the arrow velocity during release. This also allows less initial bowstring tension to be achieved while maintaining the same draw force F1.

The advantages of the present invention include, without limitation, faster increase of draw force during the drawing cycle of a bow. This allows for greater energy storage in the bow limbs, thereby resulting in an increased arrow velocity. This also eliminates the need to increase the limb poundage to achieve a higher draw force. Due to the fact that the bowstring is coming off the cam at the same angle throughout the draw stroke, a less complex cam design is achieved. Non-planar cam lean is also reduced which leads to ease of tuning a bow, which is a shortcoming of all prior art compound bows. A further advantage to the present invention includes a simple and cost effective way to decrease the angle of the bowstring relative to the arrow without the need to substantially modify the traditional looks of a bow or compound bow.

In broad embodiment, the present invention is a bow or crossbow with two idler pulleys that allow for a faster decrease in bowstring angle in relation to the arrow thereby increasing the amount of stored energy during the draw stroke and decreasing the distance required to reach peak draw weight. The two idler pulleys also allow the force draw curve to be designed around the human body kinematic strengths as opposed to the limitations of the bow geometry.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A compound archery bow comprising: an upper limb, a lower limb, a riser connecting the upper and lower limbs, a drawstring; an upper idler pulley supported by the riser, the upper idler pulley is arranged in the same plane as the bowstring and to the rearward side of the bowstring; and a lower idler pulley supported by the riser, the lower idler pulley is arranged in the same plane as the bowstring and to the rearward side of the bowstring, wherein the upper and lower idler pulleys are supported by the limbs.

2. The compound archery bow of claim 1, wherein the upper and lower idler pulleys are supported by a cable slide.

3. A compound archery bow comprising: an upper limb, a lower limb, a riser connecting the upper and lower limbs, a drawstring; an upper idler pulley supported by the riser, the upper idler pulley is arranged in the same plane as the bowstring and to the rearward side of the bowstring; and a lower idler pulley supported by the riser, the lower idler pulley is arranged in the same plane as the bowstring and to the rearward side of the bowstring, wherein the upper and lower idler pulleys are arranged at non-equal distances from the bow centerline.

4. A compound archery bow comprising: an upper limb, a lower limb, a riser connecting the upper and lower limbs, a drawstring; an upper idler pulley supported by the riser, the upper idler pulley is arranged in the same plane as the bowstring and to the rearward side of the bowstring; and a lower idler pulley supported by the riser, the lower idler pulley is arranged in the same plane as the bowstring and to the rearward side of the bowstring, wherein the upper and lower idler pulleys are adjustable.

5. A recurve bow comprising: an upper limb, a lower limb, a riser connecting the upper and lower limbs, a bowstring; an upper idler pulley supported by the riser, the upper idler pulley is arranged in the same plane as the bowstring and to the rearward side of the bowstring; and a lower idler pulley supported by the riser, the lower idler pulley is arranged in the same plane as the bowstring and to the rearward side of the bowstring.

6. A crossbow comprising: an left limb, a right limb, a riser connecting the left and right limbs, a stock, a bowstring; an left idler pulley supported by the stock, the left idler pulley is arranged in the same plane as the bowstring and to the rearward side of the bowstring; and a right idler pulley supported by the stock, the right idler pulley is arranged in the same plane as the bowstring and to the rearward side of the bowstring.

7. The crossbow of claim 6, wherein the left and right idler pulleys are supported by the limbs.

8. The crossbow of claim 6, wherein the left and right idler pulleys are arranged at equal distances from the stock centerline.

9. The crossbow of claim 6, wherein the left and right idler pulleys are arranged at non-equal distances from the stock centerline.

10. The crossbow of claim 6, wherein the left and right idler pulleys are rotatable idler pulleys.

11. The crossbow of claim 6, wherein the left and right idler pulleys are adjustable.

12. The crossbow of claim 6, wherein the left and right idler pulleys are rigidly fixed.

* * * * *